US008410930B2

(12) United States Patent
Karasek et al.

(10) Patent No.: US 8,410,930 B2
(45) Date of Patent: Apr. 2, 2013

(54) METHOD AND APPARATUS PERTAINING TO BARRIER MOVEMENT CONTROLLERS AND EMPLOYING A CAMERA AND A WIRELESS TRANSMITTER

(75) Inventors: Mark L. Karasek, Lombard, IL (US); Robert Daniel-Wayman, Lombard, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 418 days.

(21) Appl. No.: 12/761,049

(22) Filed: Apr. 15, 2010

(65) Prior Publication Data

US 2011/0254685 A1 Oct. 20, 2011

(51) Int. Cl.
*G08B 21/00* (2006.01)

(52) U.S. Cl. ..... 340/540; 340/539.11; 340/506

(58) Field of Classification Search ..... 340/540, 340/506, 522, 505, 539.11, 539.13, 539.14, 340/539.26; 379/106.01
See application file for complete search history.

(56) References Cited

U.S. PATENT DOCUMENTS

| | | | | |
|---|---|---|---|---|
| 4,360,807 | A | 11/1982 | Zettergren | |
| 4,464,651 | A * | 8/1984 | Duhame | 340/506 |
| 6,025,785 | A * | 2/2000 | Farris et al. | 340/12.29 |
| 7,113,090 | B1 * | 9/2006 | Saylor et al. | 340/539.18 |
| 7,205,892 | B2 * | 4/2007 | Luebke et al. | 340/539.26 |
| 7,468,676 | B2 | 12/2008 | Styers et al. | |
| 7,602,283 | B2 * | 10/2009 | John | 340/539.11 |
| 7,710,284 | B2 | 5/2010 | Dzurko et al. | |
| 7,869,582 | B2 * | 1/2011 | Styers et al. | 379/106.01 |
| 8,218,739 | B2 * | 7/2012 | Styers et al. | 379/106.01 |
| 2003/0071590 | A1 * | 4/2003 | Roman | 318/282 |
| 2003/0140107 | A1 * | 7/2003 | Rezvani et al. | 709/208 |
| 2004/0212498 | A1 * | 10/2004 | Peterson et al. | 340/539.25 |

* cited by examiner

*Primary Examiner* — John A Tweel, Jr.
(74) *Attorney, Agent, or Firm* — Fitch Even Tabin & Flannery LLP

(57) ABSTRACT

A control circuit, upon detecting a condition of interest, automatically forwards information regarding a recently-captured image to a predetermined recipient. Upon then later receiving an instruction (which instruction was prompted at least on behalf of the predetermined recipient), the control circuit then wirelessly transmits a movable barrier remote control signal to a corresponding barrier movement controller.

29 Claims, 4 Drawing Sheets

METHOD AND APPARATUS PERTAINING TO BARRIER MOVEMENT CONTROLLERS AND EMPLOYING A CAMERA AND A WIRELESS TRANSMITTER

TECHNICAL FIELD

This invention relates generally to barrier movement controllers and more particularly to the provision of a barrier movement remote control signal.

BACKGROUND

Barrier movement controllers of various kinds are known in the art. Such controllers typically serve to selectively move a barrier (such as a garage door, a rolling shutter, and so forth) between fully-opened and full-closed positions. In many cases, the barrier movement controller includes a wireless receiver that serves, at least in part, to receive one or more barrier movement remote control signals. Such signals can serve, for example, to prompt the controller to responsively move the barrier from a closed position to an opened position or vice versa.

The prior art leverages this ability to move a barrier in various ways. By one approach, for example, the barrier movement controller responds to detection of a possible obstacle in the path of the moving barrier by halting or reversing such movement. As another example, the barrier movement controller responds to detection of an approaching person by causing selected lighting to illuminate a given area.

In at least certain other respects, however, the prior art has not fully addressed this automated capability to move a barrier. Consider, for example, permitting automated control of a movable barrier in response to detecting a given environmental condition such as a fire or unsafe levels of carbon monoxide. Detecting such a condition in, say, a residential garage does not lead inevitably and inexorably to a need to always ensure that the movable barrier is in a particular same position (such as a fully-opened or a fully-closed position). In some cases, the appropriate action may be to cause an opened barrier to close. In other cases, however, the appropriate action may be instead the opposite; leaving an opened barrier in the opened position. Furthermore, the undesired consequences of effecting an inappropriate response to a given sensed condition in these regards can be significant.

BRIEF DESCRIPTION OF THE DRAWINGS

The above needs are at least partially met through provision of the method and apparatus pertaining to barrier movement controllers and employing a camera and a wireless transmitter described in the following detailed description, particularly when studied in conjunction with the drawings, wherein.

Figure 1:
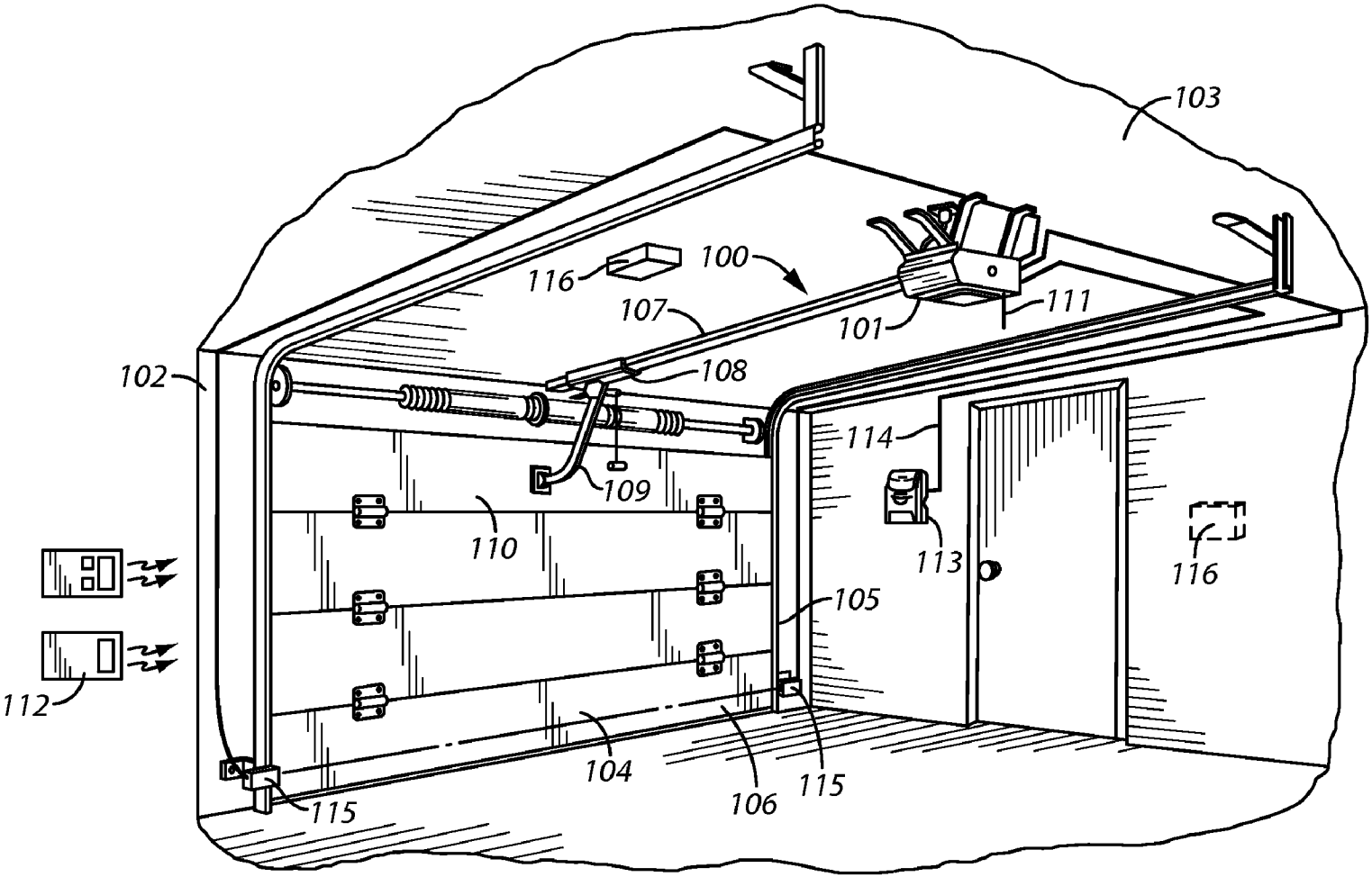
FIG. 1 comprises a perspective view (drawn largely to scale) as configured in accordance with various embodiments of the invention.

Elements in the figures are illustrated for simplicity and clarity and have not necessarily been drawn to scale unless noted otherwise. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a control circuit, upon detecting a condition of interest, automatically forwards information regarding a recently-captured image to a predetermined recipient. Upon then later receiving an instruction (which instruction was prompted at least on behalf of the predetermined recipient), the control circuit then wirelessly transmits a movable barrier remote control signal to a corresponding barrier movement controller.

By one approach, the aforementioned condition of interest comprises a gas-based condition of interest. This might comprise, for example, at least a predetermined level of carbon dioxide.

By one approach, the control circuit operably couples to a camera. This camera, in turn, serves to capture the aforementioned recently-captured image. As one example in these regards, the recently-captured image comprises an image of at least a portion of the movable barrier that corresponds to the barrier movement controller. So configured, this recently-captured image can serve to depict whether the movable barrier is closed or open.

By one approach, the control circuit forwards this image to the predetermined recipient via an extranet such as the Internet. This might comprise, for example, forwarding the image via email, a so-called tweet, a Short Message Service (SMS) message, an Instant Message (IM), or the like. If desired, the aforementioned received instruction prompted at least on behalf of the predetermined recipient can be conveyed in a similar manner.

So configured, detection of a condition of concern (such as undue heat, smoke particles, carbon monoxide, or the like) can prompt a present view of the movable barrier to be sent to one or more predetermined persons (such as the corresponding homeowner). Being apprised both of the condition of interest as well as the present position of the movable barrier, this person can then make a decision regarding whether the movable barrier should be moved at this time to a different position. That decision is then conveyed to the control circuit and a corresponding instruction transmitted to the barrier movement controller to cause the desired movement. Using this approach, of course, alleviates the previously-noted concern of making an inappropriate automated action regarding the barrier's position.

These teachings are highly flexible in practice and will accommodate use in combination with a wide variety of sensors, cameras, and barrier movement controllers. It will be appreciated that such an approach can be readily deployed in conjunction with a wide variety of already-deployed barrier movement controllers with little or no modification to the legacy equipment.

These and other benefits may become clearer upon making a thorough review and study of the following detailed description. Referring now to the drawings, and in particular to FIG. 1, it may be helpful to first describe an illustrative application setting. It will be understood that the specifics of this example are intended to serve only in an illustrative regard and are not intended to express or suggest any corresponding limitations with respect to the scope of these teachings.

In this illustrative example, a barrier movement controller 100 comprises, in part, a garage door operator 101 positioned within a garage 102. This garage door operator 101 mounts to the garage ceiling 103 and serves to control and effect selective movement of a multipanel garage door 104. The multipanel garage door 104 includes a plurality of rollers (not shown) rotatably confined within a pair of tracks 105 positioned adjacent to and on opposite sides of the garage opening 106.

The garage door operator 101 includes a head unit having a motor (not shown) to provide motion to the garage door 104 via a rail assembly 107. The rail assembly 107 includes a trolley 108 for releasable connection of the head unit to the garage door 104 via an arm 109. The arm 109 connects to an upper portion 110 of the garage door 104. The trolley 108 connects to an endless chain (or belt or the like) (not shown) that effects the desired movement of the trolley 108 and hence the door 104 via the arm 109. This chain can be driven by a sprocket (not shown) that couples to the aforementioned motor in the head unit.

The head unit may also include a radio frequency receiver (not shown) having an antenna 111 to facilitate receiving coded radio frequency transmissions from one or more radio transmitters 112. These transmitters 112 may include personally-portable transmitters (such as keyfob-style transmitters) or mobile-installed keypad transmitters (such as those often installed in automobile sun visors or headliners) as well as remotely-located non-mobile keypad transmitters (as are sometimes mounted on a wall within, for example, a garage or outside the garage on a nearby wall or framing member). The radio receiver typically connects to a processor (not shown) in the head unit that interprets received signals and responsively controls other portions of the garage door operator 101.

A wall control unit 113 communicates over a line 114 with the head unit to effect control of a garage door operator motor and other components (such as a light (not shown)). The entire head unit is typically powered from a power supply (not shown).

In addition, in this illustrative example the barrier movement controller 100 includes an obstacle detector 115 that optically or via an infrared-pulsed beam detects when the garage door opening 106 is blocked and signals the garage door operator 101 accordingly of the blockage. The aforementioned processor can then, for example, cause a reversal or opening of the door 104 to avoid contact with the obstacle.

The teachings set forth herein can be carried out, by one approach, using a corresponding implementing platform such as a dedicated component 116. This component 116 can be installed in any of a variety of locations within such a garage. For example, as shown, this component 116 can be installed on the ceiling 103 of the garage. As one illustrated alternative, it would also be possible to optionally install this component 116 on the wall of the garage. Other possibilities exist; it would be possible as well to install the component 116 on the back wall (not shown) or the floor of such a garage. It would also be possible to install the component 116 on a surface other than a garage-defining surface if desired. This could include forming the component as an integral part of the garage door operator 101 (such that, for example, the component shared the garage door operator's power supply).

Figure 2:
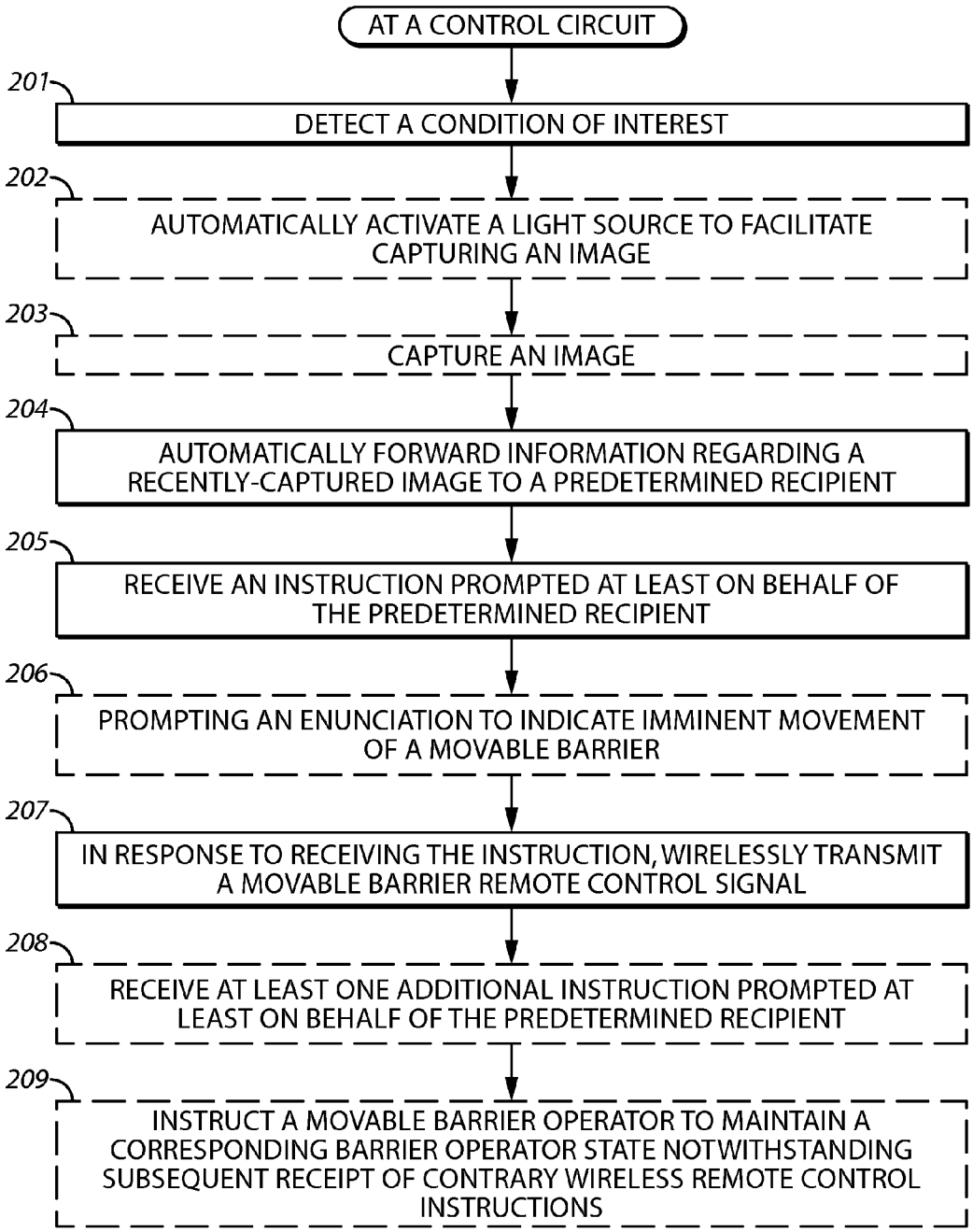
FIG. 2 comprises a flow diagram as configured in accordance with various embodiments of the invention.

As discussed below, this component 116 can comprise, in part, a control circuit. This control circuit can be configured to carry out any of a variety of steps, actions, and/or functions. To illustrate, and referring now to FIG. 2, pursuant to step 201 this control circuit can detect a condition of interest. Generally speaking, for many application settings this condition of interest can pertain to a circumstance of the local environment such as one or more contents of the local atmosphere. Examples include, but are not limited to, smoke and other similar airborne particulates and gases of various kinds When detecting a gas-based condition of interest, for example, the gas can comprise a potentially hazardous gas such as natural gas, liquid propane gas, or the like. For the sake of illustration and without intending a limitation in these regards, the remainder of this description will presume that the condition of interest comprises a level of carbon dioxide that at least equals some predetermined level (measured, for example, in parts per million).

As will be shown below, this process provides for making particular use of a recently-captured image. This image can include, for example, at least a portion of a movable barrier (such as the above-described garage door 104). To facilitate this later step, this process can optionally provide, at step 202, automatically activating a light source to facilitate capturing this image. So configured, this step 202 serves to illuminate the subject (such as the movable barrier) of the image in order to better facilitate capturing a usable image.

By one approach, this can comprise using a light source (such as a photographic flash component) dedicated to the described purpose. By another approach, in lieu of the foregoing or in combination therewith, the light source can comprise available lighting having other purposes as well. For example, in many cases a garage door operator will have corresponding work area light sources (either built in to the head unit or otherwise controlled by the head unit). The light itself can comprise light within the visible spectrum and/or other frequencies of light (such as infrared) that may be appropriate for use in a given application setting.

Along these same lines, at optional step 203 this process provides for capturing an image to form a recently-captured image of the subject of interest. As noted above, this image can comprise, at least in part, at least a part of the movable barrier at issue. In such a case, enough of the movable barrier and/or other elements of the application setting should be visible in the image to permit an assessment regarding the opened and/or closed state of the movable barrier.

By one approach, if desired, a visual element can be applied to the movable barrier to facilitate such a visual assessment. For example, a monochromatic or full-color design (such as a plurality of concentric circles in the form of a target image, a fully-symmetrical cross or cross-hairs, a series of parallel lines, or any other design of choice) can provide a simple and readily recognizable visual cue regarding a present closed/opened state of the movable barrier.

This image can be captured using any of a wide variety of digital cameras (i.e., a camera that electronically captures the contents of a photographic field of view as a corresponding digitally-encoded representation). This includes both monochromatic cameras as well as full-color cameras. This also includes, as desired, still-image cameras as well as video cameras. By one approach the camera can comprise a visible-light camera though cameras sensitive to other frequencies of light can be employed as desired.

By one approach, the image comprises a single image corresponding to a single field of view. By another approach the image can comprise a plurality of separate images or a composite image (presenting, for example, multiple views (separated, perhaps, in time) of a shared field of view or a plurality of views representing different fields of view).

Generally speaking, the field of view captured by the camera can be set by the person who installs the aforementioned component and/or by a subsequent end user. By one approach, if desired, this field of view can be made remotely adjustable (so-called pan and tilt cameras being known in the art) to permit post-installation adjustments in these regards.

In any event, and regardless of how captured, at step 204 this process provides for automatically forwarding information regarding a recently-captured image (for example, of the movable barrier) to a predetermined recipient. Generally speaking, the expression "recently-captured" refers to a temporal proximity to the step of forwarding the image. As will become more clear below, the purpose of providing this image to the recipient is to provide the recipient with information to better inform that recipient's decision-making process regarding whether to place (or to persist present placement of) the barrier in an opened or closed state. Accordingly, a relatively old image may contain stale information that misrepresents the genuinely current state of the movable barrier.

For many application settings, it may be useful if the provided information comprises the image itself. Using this approach the predetermined recipient (or an authorized surrogate) can locally render the image (using, for example, a cellphone display, a laptop or desktop display, or the like) in order to visually observe and glean the substance of the content. By another approach, if desired, this information can comprise a processed analysis or assessment of the image. This might comprise, for example, utilizing automated pattern matching to determine the present closed/opened state of the movable barrier. Using this approach, the information could comprise a text message such as "Barrier Open" or "Garage Door Closed."

By one approach, this process provides for capturing at least a portion of the aforementioned image subsequent to detecting the condition of interest. By another approach, the camera may be configured to capture images on some regular (or irregular) basis. In such a case, the image may have been captured prior to detecting the condition of interest but may nevertheless still be acceptable for these purposes as having nevertheless been captured "recently." Generally speaking, for many application settings it will be adequate that the image be captured within, say, five seconds of automatically forwarding that image as described. In other settings, it may be acceptable if the image is captured within, say, fifteen seconds, thirty seconds, one minute, or five minutes of the forwarding step.

This conveyance can be carried out using any message-bearing mechanism of choice. By one approach, this can comprise forwarding the information via an extranet (such as, but not limited to, the Internet). The control circuit's connection to this extranet can be direct or indirect (and via, for example, one or more intervening private and/or public networks) and wireless or non-wireless (in whole or in part). For many application settings this can comprise, for example, conveying the information within, or attached to, an email, a Short Message Service (SMS) message, a tweet (as effected via the Twitter service), an Instant Message (IM), or the like.

The predetermined recipient will often comprise, for example, one or more persons having responsibility for the state of the movable barrier. When the movable barrier comprises a residential garage door, for example, this might comprise the homeowner(s) or a person or agency hired or otherwise relied upon by the homeowner to receive such a message and to take a corresponding action as described herein. As another example, when the movable barrier comprises a part of a commercial or industrial facility, the predetermined recipient may comprise, for example, a facility administrator or the like.

As used herein this reference to "predetermined" refers to having determined the recipient prior to the described time of need and usage. By one approach, this can refer to having identified this particular recipient prior to having detected the condition of interest. In some cases, there may be a pre-identified pool of candidate predetermined recipients. For example, in one application setting there may be a daytime facility administrator and a nighttime facility administrator. A selection of one of these persons to receive the described information may occur, if desired, subsequent to having detected the condition of interest (in order to select the particular recipient based upon the current time of day). In such a case, as the candidate recipients have all been identified and accorded candidate-recipient status prior to having detected the condition of interest, these candidate recipients can also be viewed as being "predetermined" within the context of these teachings.

At step 205 this process then provides for receiving a responsive instruction. In some cases this instruction may be received directly from the predetermined recipient. In other cases there may be one or more forwarding, editing, and/or interpreting entities or services between the predetermined recipient and the control circuit. To account for these different possibilities, this instruction is therefore viewed as being prompted at least on behalf of the predetermined recipient.

Generally speaking, for many application settings this instruction will comprise an instruction regarding an action to be executed by the barrier movement controller. As one simple example in these regards, this can comprise a command to move the movable barrier from a present state (such as a closed state or an opened state) to an opposing state (such as an opened state or a closed state, respectively). These teachings will accommodate other possibilities in these regards as well, however. This instruction might comprise, for example, a command to cause one or more lights to illuminate a given area, to actuate an alert enunciator, to capture a new image and to forward that new image to a given recipient, and so forth (alone or in combination with the aforementioned command regarding the movable barrier).

These teachings will accommodate receiving this instruction via any message-bearing approach of choice. By one approach, for example, this instruction can be received via the same service(s) by which the control circuit provided the aforementioned information regarding the recently-captured image to the predetermined recipient. By way of illustration, an extranet such as the Internet can comprise the communication pathway by which the control circuit receives this instruction.

As noted, the received instruction can comprise an instruction to move the movable barrier. In such a case, optional step 206 serves to prompt an enunciation to indicate imminent movement of the movable barrier (to thereby warn others in the vicinity of the barrier of this imminent movement). By one approach, this control circuit can take this step 206 subsequent to (and in response to) receiving the instruction but operationally prior to transmitting a movable barrier remote control signal as described below. (As used herein, this reference to "operationally prior" refers to the fact that this enunciation is being rendered in conjunction with, but previous to, the remote control signal.) This enunciation can assume a variety of forms including audible forms (such as alert tones, beeping patterns, pre-recorded or synthesized verbal cautions or warnings, and so forth), visual forms (such as switched-on lights, flashing lights, illuminated verbal or iconic images, and so forth), and any other alerting manifestation of choice.

By one approach the control circuit can prompt this enunciation by directly effecting the desired enunciation as a native capability of the component 116. By another approach, in combination with the foregoing or in lieu thereof, the control circuit can prompt this enunciation by providing an appropriate instigating signal to another platform having enunciation capabilities (such as, in some application settings, the movable barrier controller).

In any event, regardless of whether the control circuit provides for such an enunciation, at step 207 this process provides for responding to the received instruction by wirelessly transmitting a movable barrier remote control signal (presuming, in this case, that the instruction in fact comprises an instruction as pertains to movement of the movable barrier). This signal will typically be configured (in terms of carrier frequency, protocol, and content) to be compatible with the ordinary configuration of the target barrier movement controller reception capabilities. Using this approach, the described component can be successfully employed without requiring any alterations to already-fielded barrier movement controllers.

When the barrier movement controller utilizes a fixed code to facilitate recognizing an authorized transmitter, these teachings will of course permit including a compatible fixed code when transmitting this movable barrier remote control signal. Similarly, when the barrier movement controller utilizes a so-called rolling code to facilitate recognizing authorized transmissions, these teachings will permit having the control circuit determine the appropriate rolling code and then include that determined rolling code when transmitting this movable barrier remote control signal.

The manufacturers of barrier movement controllers sometimes utilize differentiated approaches to movable barrier remote control signals. These differences can pertain, for example, to utilized carrier frequencies and/or frequency-hopping patterns, data framing and signal protocols, and message content and payloads. By one approach, the aforementioned movable barrier remote control signal can be configured in accordance with a selected one of these approaches. Using this approach the component will tend to work compatibly with the offerings of only a single manufacturer (or only a limited line or lines of products as offered by a single manufacturer). By another approach, the movable barrier remote control signal can comprise a series of transmissions, where the control circuit transmits the intended substantive instruction using each of a plurality of different approaches to thereby tend to work compatibly with a plurality of different platforms/manufacturers.

For many applications, the foregoing will suffice. These teachings are highly flexible, however, as regards accommodating the needs of a given application setting. As one example in these regards, and with continued reference to FIG. 2, at optional step 208 the control circuit can receive at least one additional instruction that has also been prompted at least on behalf of the predetermined recipient. This step can be discrete from the previously mentioned step 205 of receiving an instruction or can be combined therewith as desired.

This additional instruction can comprise, for example, an instruction to maintain a particular barrier operator state notwithstanding subsequent receipt of contrary wireless remote control instructions. At optional step 209, this instruction can then be transmitted to the movable barrier operator to presumably be carried out thereby.

So configured, the predetermined recipient (and/or their authorized surrogate) can ensure that the desired movable barrier state persists. By one approach, this condition can continue until the barrier movement operator receives a specific release instruction. By another approach, in lieu of the foregoing or in combination therewith, the instructed state can persist for some given predetermined period of time (such as ten minutes, one hour, one day, or the like). Such a capability will help to ensure that a preferred movable barrier state as set pursuant to these teachings is not undone by, for example, another person who approaches the movable barrier and attempts to alter the movable barrier state using their own wireless remote control interface. (By one approach, the barrier movement operator can be configured to respect the instruction to persist the movable barrier state upon receiving a subsequent wireless remote control signal, but to respond as instructed to a barrier movement command when a physically-tethered end-user interface (such as a wall-mounted switch that connects to the head unit via an electrical conductor) sources that command.)

Figure 3:
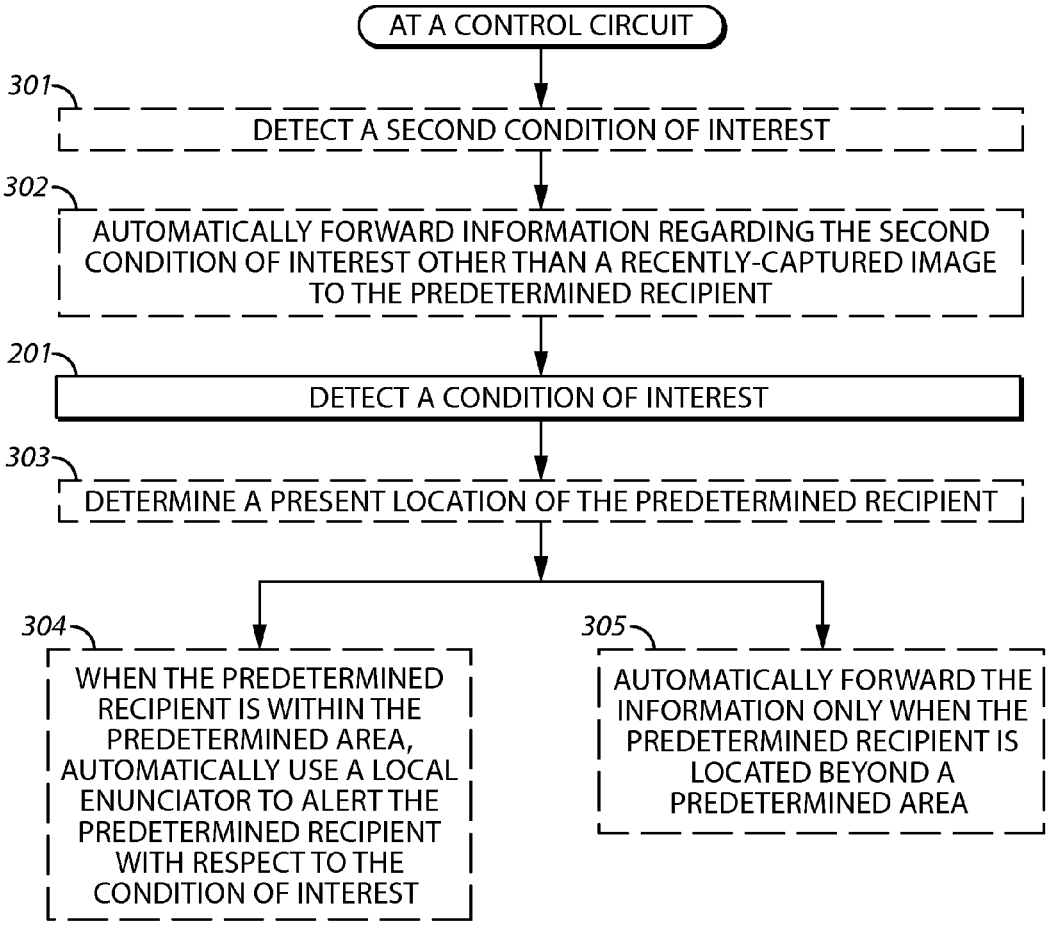
FIG. 3 comprises a flow diagram as configured in accordance with various embodiments of the invention.

As another example of the flexibility of these teachings, and referring now to FIG. 3, prior to the aforementioned step 201 of detecting a condition of interest the control circuit can, at step 301, detect a second condition of interest. As one illustrative example, in these regards, this second condition of interest can be the same condition of interest as is detected at step 201. By one approach, however, the second condition of interest can comprise a different level of sensitivity to the condition of interest. For example, when the condition of interest comprises the presence of carbon monoxide, this second condition of interest can comprise X parts per million of carbon monoxide while the previously mentioned condition of interest can comprise Y parts per million of carbon monoxide (where "Y" is a larger number than "X" and hence represents a greater concentration of carbon monoxide).

By one optional approach, if desired, this step 301 of detecting a second condition of interest (such as a lower level of carbon monoxide than would trigger the previously described transmission of a recently-captured image to the intended recipient) can prompt a local enunciation to provide a corresponding alert. (As before, this "enunciation" can comprise an audible, visual, haptic, and/or other sensible mechanism as desired. A non-exhaustive listing in these regards would include illumination of a movable barrier operator worklight, illumination of local area lighting, illuminating a light source in a strobing manner, actuating a sound-generating source, and so forth.) Such a location reaction can be in lieu of forwarding a recently-captured image as described above to the predetermined recipient.

These teachings will of course accommodate a variety of other second conditions of interest. In addition to the possibility noted above (which differs in degree with respect to the first-described condition of interest), this second condition of interest can differ in kind. As one example in these regards, when the first condition of interest is at least a first level of detected atmospheric carbon monoxide, the second condition of interest can be at least a particular level of detected temperature.

In any event, upon detecting this second condition of interest, at optional step 302 this process can provide for automatically forwarding information regarding this second condition of interest other than a recently-captured image to the predetermined recipient. This could comprise, for example, a simple email, SMS message, tweet, or the like with a brief statement (such as "CO!" or "Carbon monoxide is detected in the garage") or code (such as "Condition Yellow" or "5150").

As yet another example of the flexibility of these teachings, and with continued reference to FIG. 3, subsequent to the step 201 of detecting a condition of interest, at optional step 303 this process can automatically determine a present location (i.e., a present geographic location) of the predetermined recipient. There are various ways by which this step can be carried out. By one approach, the control circuit can poll the predetermined recipient's Global Positional System (GPS)-capable cellular telephone for this information. By another approach, the control circuit can access a presence server that maintains, perhaps amongst other things, present location information for the predetermined recipient. As these teachings are not overly sensitive to any particular selection in these regards, further elaboration in these regards will not be provided here.

Regardless of how the control circuit determines the predetermined recipient's predetermined location, at optional step 304 the control circuit uses a local enunciator (for example, as described above) to alert the predetermined recipient with respect to the condition of interest when the predetermined recipient is within a given predetermined area. This predetermined area might comprise, for example, the garage in which the component is installed. As another example, the predetermined area might comprise the residence to which the garage attaches. By one approach, this "predetermined area" can be generally defined as being a given distance from a central point (such as, for example, within 5 meters of a central point, within 10 meters of that central point, within 25 meters of that central point, and so forth).

When such is not the case (i.e., when the predetermined recipient is located beyond the predetermined area), at optional step 305 this process can provide for automatically forwarding the previously described information regarding the recently-captured image to the predetermined recipient.

Figure 4:
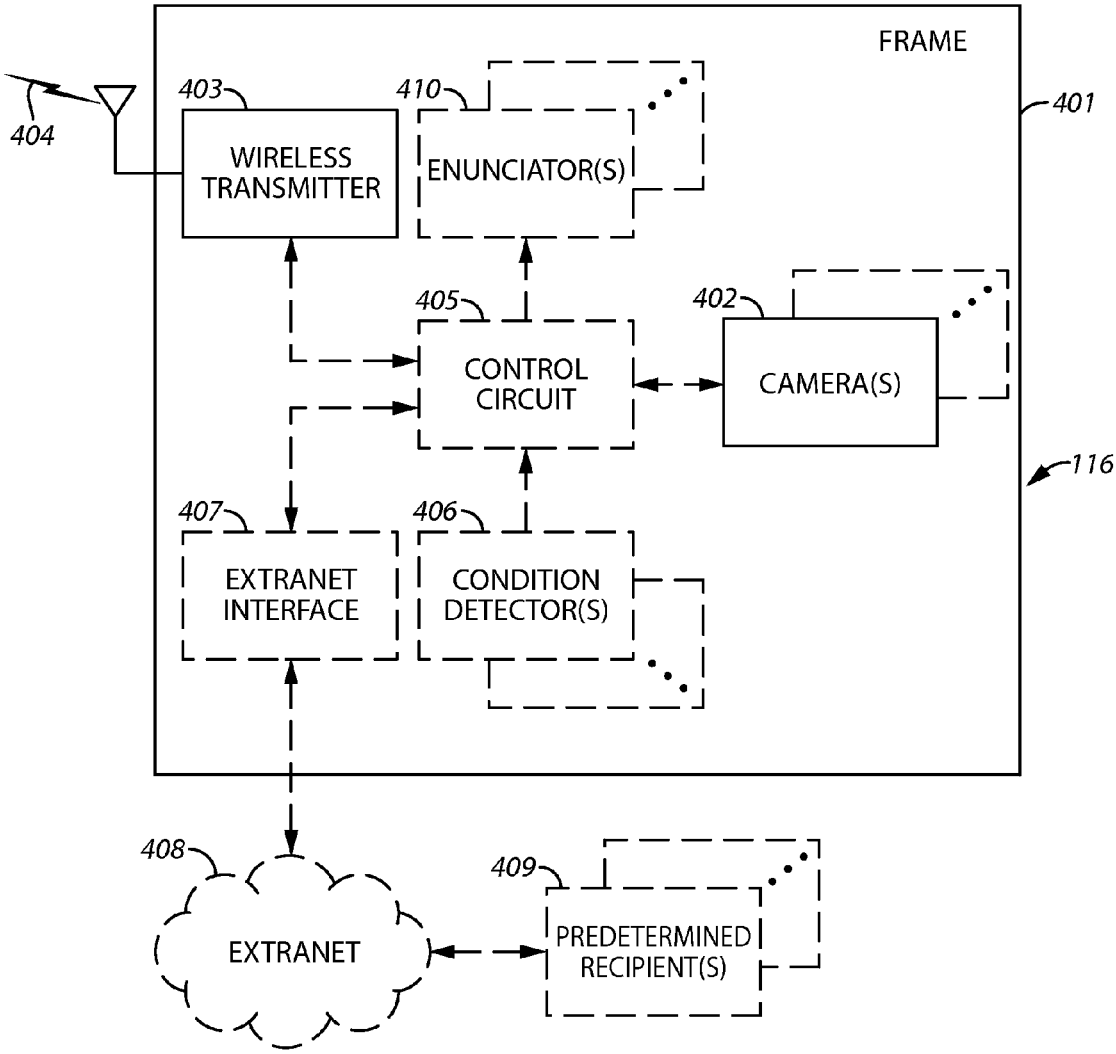
FIG. 4 comprises a block diagram as configured in accordance with various embodiments of the invention.

The above-described processes are readily enabled using any of a wide variety of available and/or readily configured platforms, including partially or wholly programmable platforms as are known in the art or dedicated purpose platforms as may be desired for some applications. Referring now to FIG. 4, an illustrative approach to such a platform will now be provided.

In this illustrative example the component 116 comprises a frame 401. This frame 401 is configured to be installed with respect to an area for which access is controlled, at least in part, by a barrier movement controller as described above. This frame 401 can itself be comprised of a single piece or a plurality of pieces that are directly or indirectly connected to one another. This frame 401, generally speaking, serves to support, directly or indirectly, the other elements of the component 116. By one point of view, this frame 401 serves to integrate and combine the other component elements to thereby aid in presenting the component 116 as a physically-singular entity notwithstanding that one or more of its individual elements may have only the shared frame 401 as a point of commonality.

This frame 401 can be comprised, for example, of a suitable structurally-rigid material such as a suitable metal or plastic of choice. By one approach the frame 401 can have holes or other apertures formed therethrough to facilitate installing the component 116 (using nails, screws, bolts, or the like) to, for example, a permanent and fixed (i.e., non-moving) surface that comprises a part of, or is located within, the aforementioned area (such as within a garage). Other possible forms of securement are possible, of course, and include a hooks-and-loops approach, use of an adhesive, and so forth. As another possibility, the "frame" can itself comprise a part of the barrier movement operator (such as the head end).

The component 116 further comprises at least one camera 402 (as described above) that is mounted, directly or indirectly, to the frame 401. In addition, the component 116 includes one or more wireless transmitters 403 (also as described above) that are also mounted to the frame 401 and that are configured to transmit the aforementioned barrier movement remote control signal 404. The camera 402 and the wireless transmitter 403 may, or may not, directly communicate with one another depending upon the desires of the designer. Similarly, these elements may, or may not, share a common power supply (not shown) as desired.

If desired, this component 116 can further comprise a control circuit 405 that also mounts to the frame 401 and that operably couples to the wireless transmitter 403 and/or the camera 402. Such a control circuit can comprise a fixed-purpose hard-wired platform or can comprise a partially or wholly programmable platform. These architectural options are well known and understood in the art and require no further description here. Generally speaking, this control circuit 405 can be configured (via, for example, appropriate programming as will be well understood by those skilled in the art) to carry out one or more of the steps, actions, and/or functions set forth herein. This can generally include, for example, controlling transmissions of the barrier movement remote control signal 404 by the wireless transmitter 403.

This component 116 can further comprise one or more condition sensors 406 of choice (such as, for example, a carbon-monoxide sensor) as described above. By one approach, one or more of these sensors 406 communicatively couple to the control circuit 405 to permit the latter to receive the detected-condition output of the former. As with the other component elements, one or more of these condition detectors 406 can be directly or indirectly mounted to the frame 401.

To facilitate the described communications with (or on behalf of) the predetermined recipient, the component 116 can further include an extranet interface 407 (or interfaces). This extranet interface 407, in turn, can communicatively couple to an extranet 408 (such as the Internet) to reach the predetermined recipient(s) 409. Such an approach will also readily accommodate other intervening communication pathways and networks such as wide-area wireless networks, short-range wireless networks, local area networks, and so forth as are known in the art or developed hereafter.

If desired, this component 116 can also include one or more enunciators 410 of choice. One or more of these enunciators 410 can be mounted, directly or indirectly, to the aforementioned frame 401 as desired. This enunciator 410 can be as described above and can include, for example, a sound-based enunciator or a visually-based enunciator. Numerous possibilities are known in these regards and further elaboration here will be avoided for the sake of brevity.

Such a component 116 may be comprised of a plurality of physically distinct elements as is suggested by the illustration shown in FIG. 4. It is also possible, however, to view this illustration as comprising a logical view, in which case one or more of these elements can be enabled and realized via a shared platform.

It will be appreciated that these teachings permit the abilities of a barrier movement operator to move a movable barrier between opened and closed positions to be leveraged to good effect in an application setting where previously such has not necessarily been the case. By appropriate application of these teachings, a person is able to be both automatically apprised of a condition of interest and to have the opportunity and ability to cause a movable barrier to move to a particular state (and/or to maintain a present state) notwithstanding that they may be considerably geographically distant from that movable barrier. Such an approach will avoid, in at least many circumstances, an inappropriate automated movement of a movable barrier upon detecting such a condition.

These teachings are readily used in conjunction with essentially any barrier movement operator that responds to wireless remote control signals. These benefits can be attained in an economically reasonable manner and these teachings are easily and readily scaled to apply with respect to a wide variety of application settings, conditions of interest, and so forth.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept. As but one example in these regards, as described above the predetermined recipient receives a recent view of the movable barrier itself to better inform their decision regarding next steps. If desired, a suitable surrogate for this image can serve instead. For example, the image sent to the recipient can comprise a photographic image of a gauge display that itself provides an analog or digital display that corresponds to a present state of the movable barrier.

As another example in these regards, based on the detected condition or conditions, different responses and/or warnings can be forwarded to the intended recipient. For example, when carbon monoxide levels are high and the temperature is elevated as well, these teachings can offer different choices to the intended recipient as versus when dealing only with elevated carbon monoxide levels. These choices might include, for example, remotely activating some other local mechanism (such as a sprinkler system or other alarm), providing an emergency contact number that the intended recipient can utilize to contact a local fire department, and so forth.

As yet another example in these regards, these teachings can support doing more than merely notifying the intended recipient of a given condition and facilitating corresponding instructions. One can, for example, provide a kind of contextual help in the form of analysis or interpretation of the detected circumstances. As one simple example in these regards, a message could be provided to the intended recipient to caution that the detected elevated temperature might indicate a fire in the garage and that this fire could become worse if the intended recipient causes the garage door to now be opened by permitting a greater flow of oxygen to the fire.

We claim:

1. An apparatus for use with a barrier movement controller that is responsive to a barrier movement remote control signal, the apparatus comprising:

a frame configured to be installed with respect to an area for which access is controlled, at least in part, by the barrier movement controller;

a camera mounted to the frame;

a wireless transmitter mounted to the frame and configured to transmit the barrier movement remote control signal;

a control circuit that is mounted to the frame and that is operably coupled to the wireless transmitter, the control circuit configured to detect a condition of interest;

wherein in response to detecting a condition of interest, the control circuit is configured to automatically forward information regarding a recently-captured image to a predetermined recipient; and wherein in response to detecting a condition of interest, the control circuit is configured to wait until a responsive instruction is received before transmitting the barrier movement remote control signal.

2. The apparatus of claim 1 wherein the camera comprises a still image camera.

3. The apparatus of claim 1 further comprising an extranet interface that is mounted to the frame.

4. The apparatus of claim 1, wherein the control circuit is configured to control transmissions of the barrier movement remote control signal by the wireless transmitter.

5. The apparatus of claim 4 further comprising:

an enunciator that is mounted to the frame and that is operably coupled to the control circuit, wherein the control circuit is configured to prompt at least one enunciation by the enunciator in response to, but operationally prior to, causing the wireless transmitter to transmit the barrier movement remote control signal.

6. The apparatus of claim 5 wherein the enunciator comprises, at least in part, a sound-based enunciator.

7. The apparatus of claim 5 wherein the enunciator comprises, at least in part, a visually-based enunciator.

8. The apparatus of claim 1 further comprising:

a gas detector mounted to the frame.

9. A method comprising:

at a control circuit:

detecting a condition of interest;

upon detecting the condition of interest, automatically forwarding information regarding a recently-captured image to a predetermined recipient;

receiving an instruction prompted at least on behalf of the predetermined recipient;

in response to detecting a condition of interest, waiting until a responsive instruction is received before wirelessly transmitting a movable barrier remote control signal.

10. The method of claim 9 wherein the condition of interest comprises a gas-based condition of interest.

11. The method of claim 10 wherein the gas-based condition of interest comprises at least a predetermined level of a gas, the gas selected from the group consisting of carbon dioxide and carbon monoxide.

12. The method of claim 9 wherein the recently-captured image comprises an image that includes, at least in part, at least a portion of a movable barrier.

13. The method of claim 9 wherein automatically forwarding a recently-captured image to a predetermined recipient comprises automatically forwarding the recently-captured image using an extranet.

14. The method of claim 13 wherein the recently-captured image comprises a series of images.

15. The method of claim 14 wherein the series of images comprises images of a same field of view.

16. The method of claim 13 wherein receiving the instruction comprises receiving the instruction via the extranet.

17. The method of claim 9 further comprising:

in response to detecting the condition of interest, capturing an image to form the recently-captured image.

18. The method of claim 17 further comprising:

automatically activating a light source to facilitate capturing the image.

19. The method of claim 9 further comprising:

in response to receiving the instruction, and prior to wirelessly transmitting the movable barrier remote control signal, prompting an enunciation to indicate imminent movement of a movable barrier.

20. The method of claim 9 further comprising:

in response to detecting a second condition of interest automatically prompting a local enunciation to provide a corresponding alert.

21. The method of claim 20 wherein the second condition of interest is the same as the condition of interest.

22. The method of claim 20 wherein the local enunciation comprises at least one of:

illumination of a movable barrier operator worklight;

illumination of local area lighting;

illuminating a light source in a strobing manner;

actuating a sound-generating source.

23. The method of claim 9 wherein wirelessly transmitting a movable barrier remote control signal comprises wireless transmitting a movable barrier remote control signal using a rolling code.

24. The method of claim 9 wherein automatically forwarding information regarding a recently-captured image to a predetermined recipient comprises sending the information as an email.

25. The method of claim 9 further comprising:

receiving at least one additional instruction prompted at least on behalf of the predetermined recipient;

in response to receiving the at least one additional instruction, instructing a movable barrier operator to maintain a corresponding barrier operator state notwithstanding subsequent receipt of contrary wireless remote control instructions.

26. The method of claim 9 further comprising:

determining a present location of the predetermined recipient;

and wherein automatically forwarding information regarding a recently-captured image to a predetermined recipient comprises automatically forwarding the information only when the predetermined recipient is located beyond a predetermined area.

27. The method of claim 26 further comprising:

when the predetermined recipient is within the predetermined area, automatically using a local enunciator to alert the predetermined recipient with respect to the condition of interest.

28. The method of claim 9 further comprising:

detecting a second condition of interest, wherein the condition of interest and the second condition of interest comprise different levels as pertain to a same condition; and in response to detecting a second condition of interest, automatically forwarding information regarding the second condition of interest.

29. The method of claim 28 wherein the information regarding the second condition of interest is information other than a recently-captured image to the predetermined recipient.

* * * * *